US006557268B1

(12) United States Patent
Berg et al.

(10) Patent No.: US 6,557,268 B1
(45) Date of Patent: May 6, 2003

(54) DRYER AND METHOD FOR DRYING CONTINUOUSLY CONVEYED PRODUCTS

(75) Inventors: Hans Berg, Schopfheim (DE); Heinrich Johann Mensing, Grevenbroich (DE); Wolfgang Lange, Schopfheim (DE)

(73) Assignee: Benninger Zell GmbH, Zell (DE)

( * ) Notice: Subject to any disclaimer, the term of this patent is extended or adjusted under 35 U.S.C. 154(b) by 0 days.

(21) Appl. No.: 09/743,793

(22) PCT Filed: May 19, 2000

(86) PCT No.: PCT/EP00/04657

§ 371 (c)(1),
(2), (4) Date: Jun. 11, 2001

(87) PCT Pub. No.: WO00/73720

PCT Pub. Date: Dec. 7, 2000

(30) Foreign Application Priority Data

May 28, 1999 (EP) ..... 99201682

(51) Int. Cl.[7] ..... F26B 5/04

(52) U.S. Cl. ..... 34/417; 34/236; 34/501; 34/620; 34/420; 34/634

(58) Field of Search ..... 34/417–422, 443–455, 34/459–464, 498, 500, 501, 507, 516, 517, 611, 614, 615, 618–621, 623, 629–634, 637–639, 643, 646, 236

(56) References Cited

U.S. PATENT DOCUMENTS 2,038,457 A * 4/1936 Venturini ..... 34/229
3,554,502 A * 1/1971 Rye et al. ..... 34/639
3,688,354 A * 9/1972 Cohn et al. ..... 26/52
3,739,491 A * 6/1973 Creapo et al. ..... 34/229
4,236,319 A * 12/1980 Gillespy ..... 28/180
4,498,250 A * 2/1985 Gageur et al. ..... 15/309.1
4,586,268 A * 5/1986 Fleissner ..... 34/242
4,905,381 A * 3/1990 Poterala ..... 34/634
5,285,582 A * 2/1994 Kouchi et al. ..... 34/229
5,287,637 A * 2/1994 Dixit et al. ..... 226/173
5,390,428 A * 2/1995 Pummell ..... 34/273
6,092,298 A * 7/2000 Salminen et al. ..... 162/902
6,092,303 A * 7/2000 Piccinino, Jr. et al. ..... 34/421
6,094,834 A * 8/2000 Taipale et al. ..... 34/116
6,345,453 B1 * 2/2002 Ilomäki et al. ..... 134/122 R

FOREIGN PATENT DOCUMENTS

DE 21 30 610 A * 12/1972 ..... D06C/3/00
DE 25 02 367 A * 12/1975 ..... F26B/13/02
GB 703283 A * 2/1954
WO WO 97/43479 A1 * 11/1997 ..... D06B/21/00

* cited by examiner

*Primary Examiner*—Ira S. Lazarus
*Assistant Examiner*—Andrea M. Ragonese
(74) *Attorney, Agent, or Firm*—Shoemaker and Mattare

(57) ABSTRACT

The invention relates to a dryer (1) for drying continuously conveyed products, e.g. a warp, comprising essentially a first dryer array (2) and a second dryer array (3). A passage (4) for passing through the product (W) is formed between the dryer arrays (2, 3). The second dryer array (3) is configured in such a way as to be able to move in relation to the first dryer array (2). When the dryer (1) is in stop position (S), the second dryer array (3) is disposed relative to the first dryer array (2) in such a way that the cross section of the passage (4) is bigger than in the operating position (B).

11 Claims, 3 Drawing Sheets

DRYER AND METHOD FOR DRYING CONTINUOUSLY CONVEYED PRODUCTS

Figure 1:
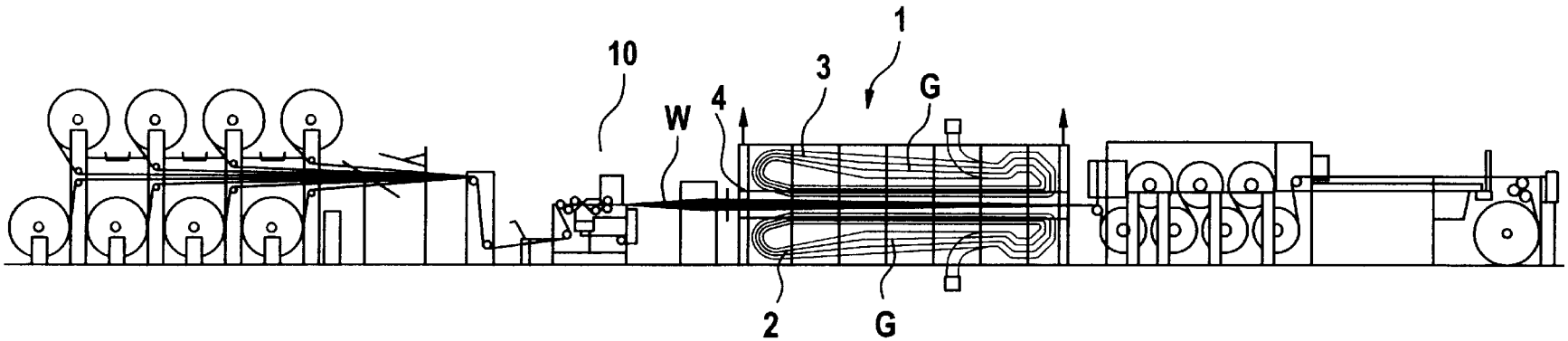

The invention relates to a dryer for drying continuously conveyed products and to a method for drying continuously conveyed products, with the features of the preamble of the independent patent claims.

In textile processing there are applied dryers in a multitude of different embodiment forms for drying threads or material webs which have been treated with water or other media. For drying, for example heated air is applied which vapourises the fluids, for example the water, and leads away the water vapour.

Such driers are also applied with the sizing of threads. After the application of the sizing material onto the threads, excess water must be removed from the threads in a drying procedure.

The productivity of such driers is dependent on various parameters. The higher the temperature of the dryer is selected, the higher is the drying effect and the more quickly the installation may be operated. The temperature may however not be chosen infinitely high since too high temperatures would destroy the threads consisting of plastic or containing plastics.

A high drying performance may furthermore be achieved in that simultaneously several threads in a thread assemblage are led through the dryer. At the same time it is possible to lead several layers of thread over one another through the dryer. However as soon as too large a number of layers of threads lie over one another there exists the danger that threads lying in the inside of the thread assemblage are no longer sufficiently dried.

The problem of the destruction of threads on account of too great a heat is particularly large with a standstill of the installation, for example caused by a thread breakage. If the installation stands still, the water located on the threads in the dryer is vapourised. As soon as all the water has vapourised the thread itself heats up. If the heat in the dryer with a standstill is not immediately led away, it may lead to a destruction of the threads. It is therefore already known with such dryers to provide openable flaps which with a standstill of the installation are opened automatically or by hand.

It is the object of the present invention to further improve the known dryer and drying method with respect to the productivity and at the same time to reduce the risk of the destruction of the threads by way of too high temperatures. The introduction of the threads into the dryer by way of the operating personnel is furthermore to be simplified. According to the invention this object is achieved with a dryer for drying continuously conveyed products and with a method for the stoppage or temporary interrupton of the drying, with the features of the characterising parts of the independent patent claims.

The dryer for drying continuously conveyed products is in particular applied for drying a sized thread assemblage. It is however also conceivable to apply such driers in other fields of application such as for drying material webs. The dryer comprises a first dryer arrangement and a second dryer arrangement, between which there is formed a passage for leading through the products to be dried. The first dryer arrangement and the second dryer arrangement are designed movable with respect to one another such that the passage for leading through the product in a stoppage state of the dryer is larger, i.e. has a larger cross section, than in an operational state. The provision of two dryer arrangements permits an effective drying of larger thread assemblages, since heat acts on the thread assemblage from two sides. The danger of damage to the threads by too high temperatures is however reliably reduced in that the dryer with an installation standstill may be moved into a stoppage state. Since in the stoppage state the passage is formed larger than in the operational state, the heat may escape. The danger of a heat accumulation is avoided.

Simultaneously after a thread breakage the broken thread or threads, by the operating personnel in a simple manner may be led through the passage for leading through the product, since this passage in the stoppage state is larger than in the operational state.

In a preferred embodiment example the first and the second dryer arrangement are arranged over one another and the second upper-lying dryer arrangement is designed in a liftable manner. With an installation standstill the second dryer arrangement is lifted into the stoppage state. With this the dryer arrangements remain essentially parallel to one another. In the operational state the cross section of the passage corresponds roughly to the cross section of the thread assemblage. In the lifted stoppage state the passage has a larger cross section. The hot air may laterally escape between the dryer arrangements. Simultaneously a new thread may be led by the operating personnel in a simple manner from the side of the dryer through the gap between the lower edge of the upper dryer and the upper edge of the lower dryer.

In this context it is advantageous when the space around the dryer is free from installations, e.g. supports or likewise, so that the access to the gap is not made difficult.

In a further preferred embodiment example the dryer arrangements are designed as warm air dryers in which a warm gas flow may be led preferably roughly parallel along the product.

For heating the air flow the dryer may be provided with one or more gas burners. Advantageously each dryer arrangement comprises several, preferably two gas burners. The gas burners may be individually controllable. With this it is possible to achieve a homogeneous temperature distribution of the air over the whole width of the dryer. The heating-up of the air flow by way of a vapour or thermo-oil damper register is likewise conceivable.

In a further preferred embodiment example the passage between the first and the second dryer arrangement is laterally sealed. The lateral sealing prevents heat loss in the normal operating condition.

According to a further aspect of the invention there is provided a dryer for drying a continuously conveyed product, in particular for drying a sized thread assemblage, which comprises a first and a second drier arrangement. The product to be dried is led through between the first and the second dryer arrangement. According to this aspect of the invention the first dryer arrangement and the second dryer arrangement are designed as a warm air dryer in which a warm gas flow is readable parallel along the product. Since the drying is effected from two sides of the product it is possible to dry thicker thread assemblages without there existing the danger that the heat does not reach the threads lying further inwards in the assemblage. The quantity of simultaneously dried threads may therefore be increased with a treatment speed which stays the same. The first and the second dryer arrangement are at the same time preferably designed symmetrical to one another with respect to a plane of symmetry. The plane of symmetry lies roughly in the middle of the path for the product to be dried. Thus the invention, with a dryer arrangement known per se with a warm air flow parallel to the product, envisages providing a second identical dryer arrangement on the opposite side of the product.

According to the method according to the invention for stopping or for the temporary interruption of the drying of a continuously conveyed product, in particular a dryer as previously described is applied. The movement of the product is stopped, for example on account of a thread breakage. In order to prevent there resulting a heat accumulation in the inside of the dryer, which could lead to a destruction of the products, the first dryer arrangement is moved with respect to the second dryer arrangement such that the passage for the product formed between the first and the second dryer arrangement enlarges. In a preferred embodiment example the second dryer arrangement lying above the first dryer arrangement is lifted.

Of course further embodiment examples are conceivable which fall under the scope of the invention. Thus e.g. it is conceivable to fold up or laterally displace the upper lying second dryer arrangement instead of lifting it. It would also be conceivable to laterally displace or sink the lower lying first dryer arrangement. It is furthermore likewise conceivable to provide dryer arrangements lying laterally next to one another.

The invention is hereinafter described in more detail in embodiment examples and by way of the drawings. There are shown in FIG. 1 a schematic representation of an installation for sizing threads, with a dryer according to the invention, FIG. 2 a cross section through a dryer according to the invention, in an operational position, FIG. 3 a lateral view of the dryer arrangement of FIG. 2 in the operational state, FIG. 4 a cross section through the dryer according to FIG. 2 in a stoppage state, FIG. 5 a lateral view of the dryer arrangements in the stoppage state.

FIG. 1 shows schematically a device for sizing threads, for example warps, which comprises a dryer 1 with the features of the invention. The warp W to be sized in a sizing material deposition device 10 is impinged with sizing material and subsequently led through the dryer 1. The dryer 1 consists essentially of two dryer arrangements 2, 3. Between the lower dryer arrangement 2 and the upper dryer arrangement 3 there is arranged a passage 4 for the product W to be dried. The dryer arrangements 2, 3 are designed as warm air dryers. The product W from above and from below is impinged with a hot gas flow G which runs roughly parallel to the product W.

Figure 2:
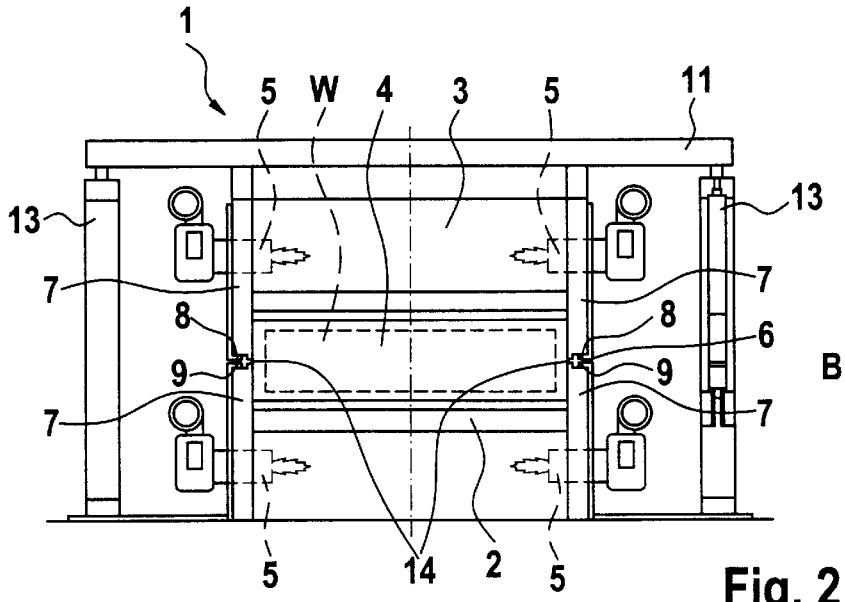

In FIG. 2 there is shown a cross section through the dryer 1. Between the lower dryer arrangement 2 and an upper dryer arrangement 3 there is formed a passage 4 with a roughly rectangular cross section. The passage 4 serves for example for receiving an assemblage from a warp thread W to be dried. The warp threads are arranged in an assemblage with a matrix-like cross section. The dryer arrangements 2, 3 comprise lateral walls 7 which laterally limit the passage 4. The gap 14 which is formed between the lower edge 8 of the side wall 7 of the upper dryer arrangement 3 and the upper edge 9 of the side wall 7 of the lower dryer arrangement 2 is sealed with a sealing means 6. As a sealing means glass tissue may for example be applied.

The dryer arrangements are provided with gas burners 5. Each dryer arrangement 2, 3 comprises on both sides in each case a gas burner 5. The air circulating in the dryer arrangements 2, 3 may with this be homogeneously heated.

The upper dryer arrangement 3 is suspended on a frame 11. The frame 11 is supported on lateral supports 13 and by way of a non-shown actuation means of an electric motor and threaded spindles, may be lifted. In the operational position B (see FIG. 2) the upper dryer 3 is arranged such that the gap 14 between the side walls 7 of the lower dryer arrangement 2 and the upper dryer arrangement 3 is closed.

Figure 3:
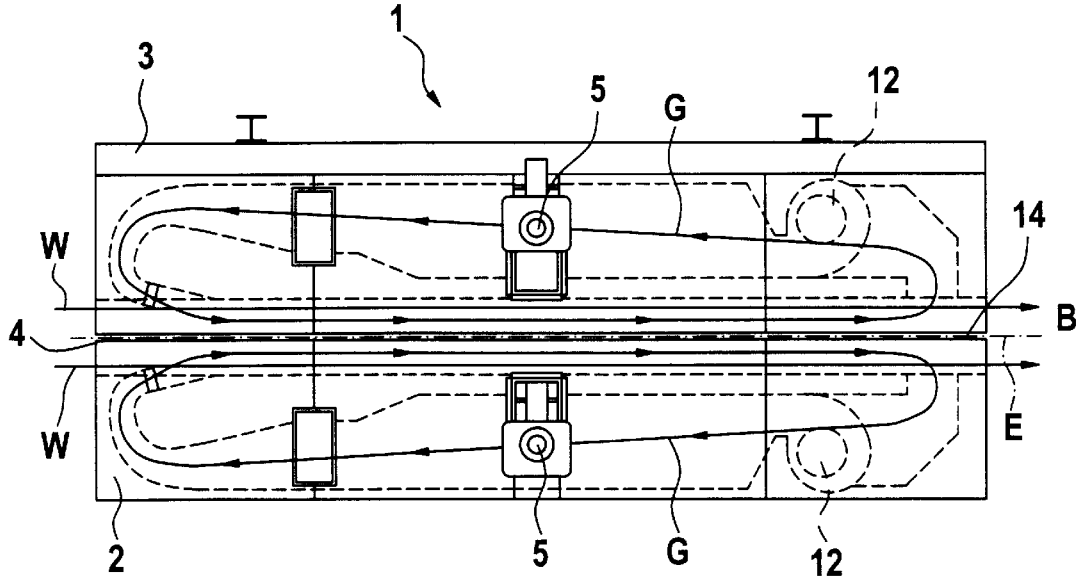

FIG. 3 shows the two dryer arrangements 2, 3 according to FIG. 2 in a lateral view. Each dryer arrangement comprises ventilators 12. The ventilators 12 are arranged in the region of the run-out of the product W to be dried. The fan 12 produces a circulating gas flow G. The gas flow G is heated in the gas burners 5 and in the region of the run-in of the product into the dryer 1 blown roughly parallel to the product W into the passage 4. The gas flow G in the region of the run-out of the product W is again suctioned out of the dryer by the fans 12, by which means there results a circulation. It is also conceivable in the known manner to lead away a part of the circulating gas flow G and to replace this by way of fresh air in order to reduce the moisture content of the air of the gas flow. The gas flow G is generally a pure air flow which contains water vapour. It would however also be conceivable for treating the product W to supply treatment media to the gas flow.

The lower dryer arrangement 2 and the upper dryer arrangement 3 are essentially designed identically and designed symmetrically with respect to a plane of symmetry E lying roughly in the middle of the path for the product W.

Figure 4:
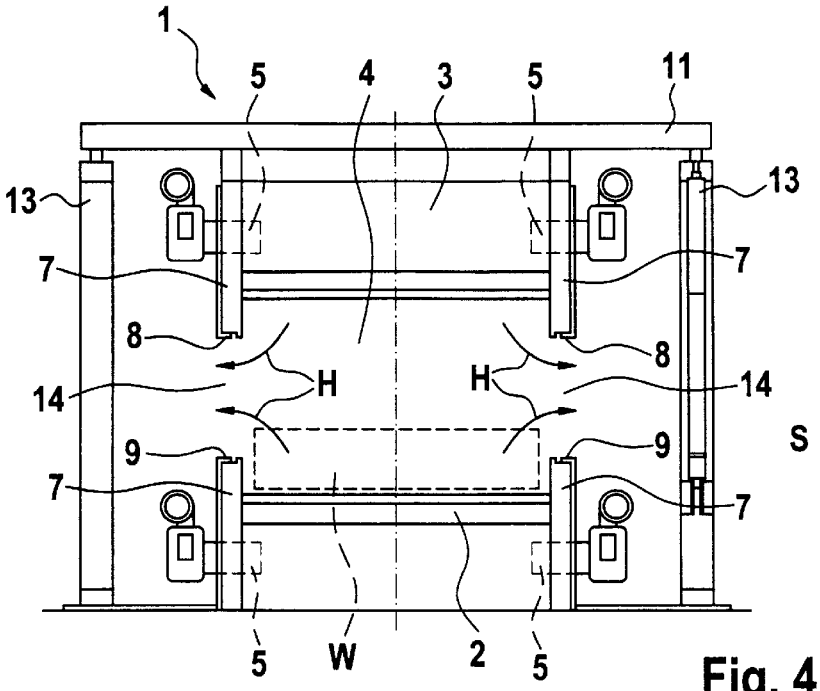

With a standstill of the installation, for example on account of a thread breakage, the upper dryer arrangement 3 is lifted into a stoppage state S. FIG. 4 shows a cross section of the dryer 1 in the stoppage state S. The passage formed between the lower dryer arrangement 2 and the upper dryer arrangement 3 comprises with this a larger cross section in comparison to the operational state B. The gap 14 formed between the upper edge 9 of the side wall 7 of the lower dryer arrangement 2 and the lower edge 8 of the side wall 7 of the upper dryer arrangement 3 is in contrast to the operational state B no longer closed. The heat H prevailing in the passage 4 may as schematically represented with arrows escape through the gap 14. In the shown embodiment example the upper dryer arrangement 3 is lifted by 80 cm. The gap 14 thus measures 80 cm. The upper dryer arrangement 3 is lifted at a speed of 50 mm per second so that the stoppage state is achieved after 16 seconds. The speed is furthermore variable adjustable.

In the case of a thread breakage furthermore it is possible for the operating personnel in a simple manner to lead new threads from the side through the gap along the dryer 1. The inside of the dryer, in particular the passage 4, on account of the gap 14 is easily accessible from the outside.

Figure 5:
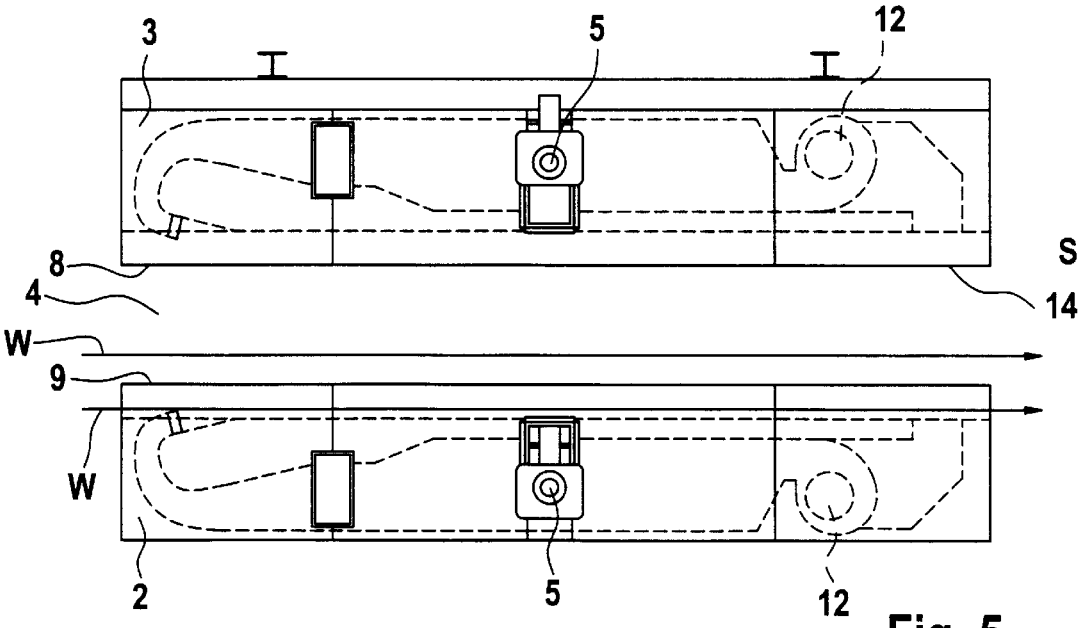

FIG. 5 shows the dryer arrangements 2, 3 in a lateral view and in the stoppage state S. The product W may after a thread breakage be guided from the side via the gap 14 through the dryer.

The upper dryer arrangement 3 in the case of an operation interruption is lifted, preferably motorically. The lifting may be triggered manually or automatically. Automatic triggering may for example be effected as a result of a thread breakage (which may be detected automatically or manually) or also as a result of excessive temperature.

In the stoppage condition S the dryer arrangements 2, 3 are further advantageously switched off. This first and foremost means that the gas burner B and the fans 12 are set out of operation.

The dryer 1 according to the invention permits the efficient drying of products, for example an assemblage of warp threads. Typically, simultaneously up to 10,000 warp threads are led through the dryer. In the dryer a gas flow G with a temperature of up to 260° C. is led over the product W. The temperature of the gas flow G may be selected so high since on account of the opened gap 14 in the stoppage state S there arises no heat accumulation in the inside of the dryer 1.

An efficient drying may be achieved in a similar manner when a first and a second dryer arrangement is applied in the way shown in FIG. 3. At the same time it is not necessarily compelling to design the first and the second dryer arrangement mutually movable if suitable precautions are made for preventing a heat accumulation. Thus for example laterally openable flaps in the case of an operational interruption may simplify the flowing away of the hot gas flow G and permit the lateral access to the product W.

Suitable flaps may be actuated automatically or also by hand.

What is claimed is:

1. A dryer for drying a continuously conveyed product or a warp with a first dryer arrangement and a second dryer arrangement, the first dryer arrangement and the second dryer arrangement comprising side walls, and forming a passage through which the product is conveyed, wherein the first dryer arrangement and the second dryer arrangement are movable relative to one another in a manner such that the passage in a first, stoppage position has a larger cross section than in a second, operational position, the first and the second dryer arrangements are arranged above one another, the second dryer arrangement is liftable, the first dryer arrangement and the second dryer arrangement remain essentially parallel to one another in said first position, and a gap is formed between a lower edge of the side walls of an upper dryer arrangement and an upper edge of the side walls of a lower dryer arrangement, said gap being essentially sealed in the second position, and open in the first position.

2. A dryer according to claim 1, wherein the dryer arrangements are warm air dryers and direct a warm gas flow substantially parallel to the product.

3. A dryer according to claim 1, wherein the at least one of the first dryer arrangement and the second dryer arrangement comprises at least one gas burner for heating a gas flow.

4. A dryer according to claim 3, wherein each dryer arrangement comprises several gas burners.

5. A dryer according to claim 4, wherein each dryer arrangement comprises two gas burners.

6. A dryer according to claim 4, wherein said gas burners are individually controllable.

7. A dryer according to claim 1, wherein the first dryer arrangement and the second dryer arrangement are designed essentially in a mirrored manner with respect to a plane of symmetry.

8. A dryer according to claim 1, wherein said conveyed product is a thread assemblage.

9. A dryer according to claim 1, wherein said conveyed product is a sized thread assemblage.

10. A method for stopping and temporarily interrupting drying of a continuously conveyed product, when conveying movement of the product is stopped, said method comprising steps of:

lifting a second dryer arrangement relative to a first dryer arrangement upon or shortly after stoppage of the conveying movement of the product, said first dryer arrangement and said second dryer arrangement being arranged one above another and said first dryer arrangement and said second dryer arrangement remaining essentially parallel to one another; and forming a gap between a lower edge of side walls of an upper dryer arrangement and an upper edge of side walls of a lower dryer arrangement, said gap being essentially sealed in an operational position and wherein said gap being open in a stoppage position.

11. A method according to claim 10, wherein said method uses a dryer having a first dryer arrangement and a second dryer arrangement and wherein a warm gas flow is directed substantially parallel along the product.

* * * * *